United States Patent [19]

Runquist

[11] 4,102,318

[45] Jul. 25, 1978

[54] STRATIFIED COMBUSTION FURNACE

[76] Inventor: Paul W. Runquist, 1030 Neil Creek Rd., Ashland, Oreg. 97520

[21] Appl. No.: 738,733

[22] Filed: Nov. 4, 1976

[51] Int. Cl.[2] ..... F24H 3/10

[52] U.S. Cl. ..... 126/103; 126/76

[58] Field of Search ..... 126/103, 76, 193

[56] References Cited

U.S. PATENT DOCUMENTS

| | | | |
|---|---|---|---|
| 633,715 | 9/1899 | Carter | 126/65 |
| 736,740 | 8/1903 | Kirch | 126/76 |
| 843,104 | 2/1907 | Roell | 126/103 X |
| 2,374,707 | 5/1945 | Sharpe | 126/103 X |
| 2,564,713 | 8/1951 | Miles | 126/76 X |
| 3,874,362 | 4/1975 | Kapustin | 126/76 X |

*Primary Examiner*—William E. Wayner
*Assistant Examiner*—William E. Tapolcai, Jr.
*Attorney, Agent, or Firm*—Clarence M. Crews

[57] ABSTRACT

This invention has to do with apparatus for burning solid fuels in successive stages whereby the fuel is completely converted to clean, hot, incombustible gases and to ashes, and, without admixture, transfers its heat to clean fresh air for distribution to areas to be heated.

6 Claims, 1 Drawing Figure

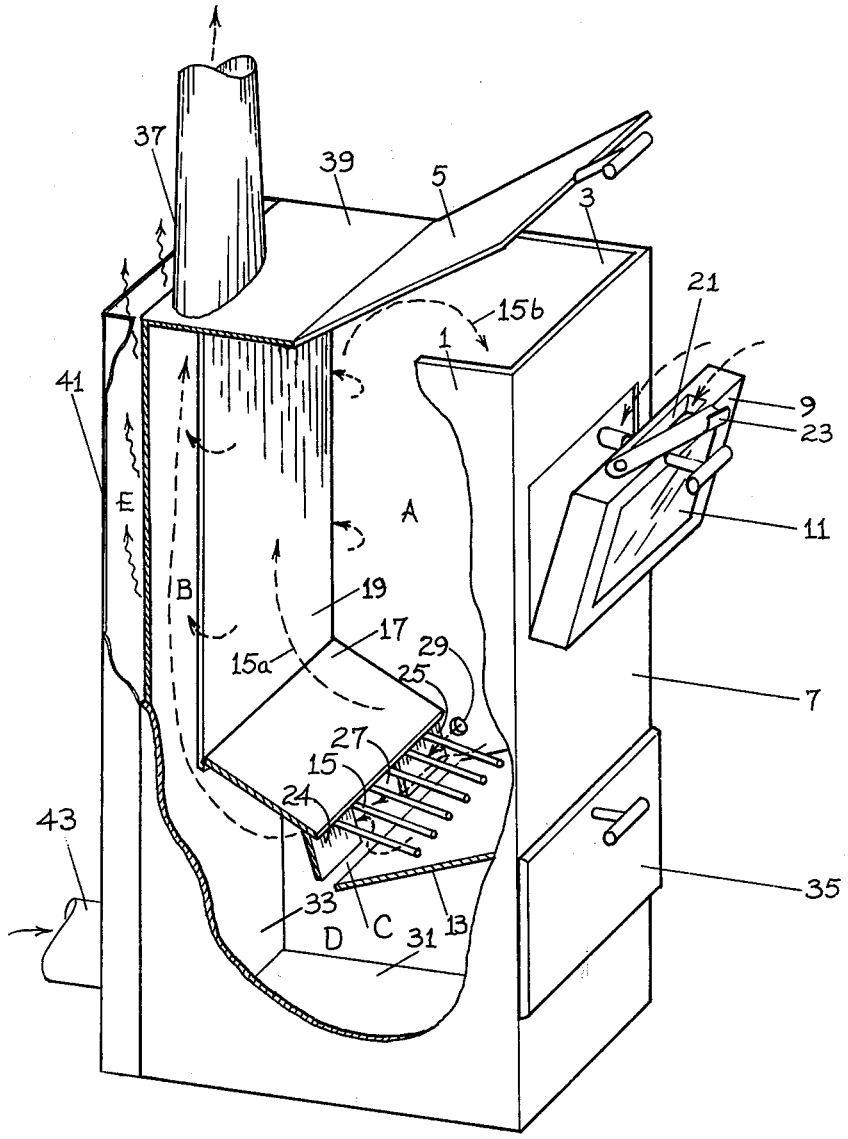
37
39
5
3
21
15b
1
41
9
23
E
A
11
B
19
17
29
15a
25
7
27
15
24
43
35
33
C
13
D
31

STRATIFIED COMBUSTION FURNACE

This invention embodies a new and useful improvement in furnace construction utilizing a multi-stage combustion process which takes maximum advantage of air circulation, distribution and draft forces to produce two high temperature burning stages preceded by a low temperature stage.

Although the furnace to be described is primarily designed for use in domestic heating, other applications are clearly available.

The objectives of this furnace construction are to provide for complete combustion of fuels by fulfilling the following requirements:

(1) The provision of a primary stage of combustion in which normal thermal decomposition, volatilization of fuels and some burning occurs with the highest efficiency possible. This is accomplished by encouraging the circulation pattern in a primary combustion chamber through the maximum utilization of the draft force of the intake air and the taking of constructive advantage of a thermal syphon created during combustion.

(2) The creation of a high temperature stage through which the gaseous products of the primary stage of combustion must pass in order to complete oxidation of smoke and volatile fuel components.

(3) The provision of a sufficient detention time in this high temperature stage with additional air and mixing to assure completion of the second stage objective and reduction of carbon monoxide concentrations.

(4) The retention of solid fuel components in the combustion chambers until they are completely reduced to ashes.

(5) The provision of means for effecting a natural separation of ashes from the solid fuels so that ashes can be independently removed.

(6) The provision of means for capturing the heat of combustion generated in the burning stages for heating purposes; and (7) The provision of means whereby air from outside the building is caused to enter the building preheated, rather than at outdoor temperature.

The exact construction of a preferred embodiment of the invention and its components will become clear from the following description together with reference to the accompanying drawing.

The single FIGURE is a perspective view of a preferred embodiment of the invention with a portion of a side wall broken away. The dashed arrows represent predominant flow patterns essential to the invention.

Referring to the drawing, primary combustion chamber A comprises side walls 1 and 3, a hinged air-tight lid 5, and a front panel 7. A kindling door 9 is hingedly mounted on the front panel 7, the door being fitted with a viewing glass 11. A sloping front funnel plate 13 is affixed to the front panel 7. A grate structure consisting of a plurality of grate bars 15, affixed to a rear funnel plate 17, depends from a separator plate 19.

In the chamber thus formed, solid fuel may be fed through the opening normally covered by the air-tight, fitting lid 5 onto the grate 15. The starting of the fire is accomplished through the kindling door 9. Air is admitted during this procedure by keeping the kindling door 9 at least partly open, as illustrated in the drawing. The kindling door 9 is hinged at the bottom so that air admitted will have a downward flow directed toward the grate 15. A circulation pattern is established in the primary combustion chamber A, which circulation pattern may rise in the rear and fall in the front as indicated by arrows **15*a* and 15*b*. With the lid 5** closed, this greatly improves the starting efficiency and helps initiate a downdraft through the grate. The downdraft is, however, primarily induced by other means which will be described presently.

After the fire is established, the kindling door 9 is closed. Air is then allowed to enter through a slot 21 in the top of the kindling door 9, which slot is fitted with a pivotally mounted damper 23 to control the rate of flow of air into the primary combustion chamber A.

The separator plate 19 in the rear of the primary combustion chamber A is spaced slighty from the side walls 1 and 3 to allow a relatively small flow of air from the primary combustion chamber A into a heat exchange chamber B as illustrated in the drawing. This flow helps to initiate an updraft through chimney 37 during start-up, and the chimney subsequently serves to maintain a downdraft through the chamber A, the grate 15 and the secondary combustion chamber C. It also helps, of course, in avoiding smoke accumulation in the primary combustion chamber A.

The front and rear funnel plates 13 and 17 are so inclined as to provide a natural migration of coals downwardly towards the grate formed by bars 15, and to concentrate the coals on the grate 15 in a relatively small area as compared to the total horizontal cross-section of the primary combustion chamber A. This concentration of coals is essential to ensure that the grate is adequately covered and to effect an acceleration of the air and the gaseous products of primary combustion as they pass downward through the grate 15 and the coals thereon.

The consequence of the high velocity of air and the gaseous products of combustion passing through the coals on 15 has been observed to be a temperature increase to as high as 1600° F when wood is used as the fuel. The burning of smoke and of combustible gases produced by the primary combustion occurs in this secondary stage.

The front funnel plate 13 extends to the rear of the grate 15 and forms the bottom of a reactor chamber C. Extending from each of the side walls 1 and 3 are baffles 24 and 25 which form rear boundaries of the reactor chamber C. The grate 15 forms the top of the reactor chamber C and the inlet to said chamber. The baffles 24 and 25 are positioned as shown in the drawing so that a space 27 is left between them which serves as the principal outlet of the reactor chamber C. The area of the outlet space 27 is significantly smaller than the area of the grate 15 with the consequence that a secondary flow acceleration is induced. The baffles 24 and 25 are also spaced with respect to the rear margin of the front funnel plate 13 to allow the passage of ashes into the ash collecting chamber D.

In each of the side walls 1 and 3 is formed a small hole or air jet 29 (one shown) which forms a secondary air jet and functions to allow passage of a small amount of air into the reactor chamber C.

In function, the reactor chamber C serves to fulfill requirements (3) and (4) as described above.

Firstly, the heat and flames originating in the coals above the grate 15 are given a detention time in the reactor chamber C. The dispersed lines of flow from the dispersed openings in the grate 15 are mixed and intermingled with additional oxygen supplied through the secondary air jets 29 providing for an intimate contact of incompletely burned combustion products and oxygen at a high temperature. The lines of flow are united and aligned as they leave the reactor chamber C through the reactor outlet 27. In the third stage additional reductions in carbon monoxide and other combustible gases are accomplished.

Secondly, the reactor chamber C functions to retain coals sufficiently reduced in size to pass through the grate 15. This extra detention time for the coals assures their complete combustion to ashes. Ashes slowly migrate down the rear extension of the front funnel plate 13 before falling off the plate. Some of the ashes, at least, are blown through the reactor outlet 27 into the ash collecting chamber D.

The ash collecting chamber D is formed jointly by the two side walls 1 and 3, a base plate 31, a rear wall 33, front and rear funnel plates 13 and 17, and the front panel 7. On the front panel 7 is mounted an ash removal door 35.

In function the ash collection chamber D serves to separate ashes from exhaust gases. When necessary, ashes are removed through the ash door 35.

Above the ash chamber D and behind the separator plate 19 is located a heat exchange chamber B through which the exhaust gases rise prior to entering a chimney 37.

The heat exchange chamber B is formed by the side walls 1 and 3, the rear wall 33, the separator plate 19, and the top wall 39. The heat exchange chamber B is so dimensioned as to retain a low flow impedance while offering a maximum external surface area by virtue of the rear wall 33 which may if desired, be finned or corrugated or otherwise modified to increase its surface area. As the heated exhaust products rise through the heat exchange chamber B, heat is transferred to the rear wall 33. The external facing surface of the rear wall 33 is opposed by a spaced panel 41 to form a duct E between them which is shown open at the top and closed at the bottom except for an air inlet 43. The air duct E bounded by 33, 41, 3 and 1 and open at the top, serves to allow convection or forced air to absorb the heat accumulated by the rear wall 33 and to deliver it to the room or space being heated.

An air inlet 43 ordinarily connects the passage E with the exterior of the building so that fresh air enters the living space preheated by passage through the duct E.

I have described what I believe to be the best embodiment of my invention. What I desire to cover by letters patent, however, is set forth in the appended claims.

I claim:

1. A plural stage, log burning, down draft heating apparatus for heating and delivering clean air to enclosed areas of a building comprising, in combination, (a) a primary combustion chamber of generally uniform rectangular horizontal cross-section through which solid fuel, such as logs, and air may be supplied for the purpose of combustion, and having an outlet substantially narrowed in one horizontal dimension only for the products of combustion at its lower extremity, (b) a grate of much smaller width than the unreduced horizontal width of the primary combustion chamber, disposed across said outlet, through which grate embers of restricted size and most of the gaseous products of combustion are required to pass downward, (c) convergent means in said combustion chamber for funneling solid fuel onto the grate, (d) means located beneath the grate for intercepting embers that fall through the grate and detaining them until they have been burned down to much smaller dimensions than the maximum that can be passed by the grate, so that a secondary down draft combustion chamber is provided, (e) a bottom receptacle communicating with said secondary combustion chamber for the reception and accumulation of ashes and the transmission of the gaseous products of combustion, and (f) upwardly extending gas discharge means communicating with the bottom receptacle and extending above the down draft heating apparatus for inducing the gaseous products of combustion to flow downward through the primary and secondary combustion chambers into said bottom receptacle and for discharging them thence upward into the atmosphere.

2. A structure as set forth in claim 1 in which the grate consists of a series of closely spaced parallel bars.

3. A structure as set forth in claim 1 in which a relatively small second combustion chamber, located below the first, is divided from the first by the grate and receives the solid residue together with the gaseous products of combustion from the first chamber together with unexpended air, for the burning of solid combustible residue including smoke particles, said second chamber having an outlet at its lower extremity substantially smaller than the grate area for defining a second combustion area, and providing for transmission downward of ashes and the accelerated transmission downward of the gaseous products of combustion.

4. A structure as set forth in claim 3 in which the second chamber is provided with fixed permanent small inlet means for the limited admission of atmospheric air.

5. A structure as set forth in claim 2 which further includes means for conducting atmospheric air, without admixture, in intimate, heat exchanging relation with said gas discharge means.

6. A structure as set forth in claim 5 in which means are provided for inducing down flow of air through the combustion chambers including a chimney in communication with the second chamber which conducts all the gaseous products of combustion to an elevation substantially above the first chamber.

* * * * *